US005140315A

United States Patent [19]

Edelson et al.

[11] Patent Number: 5,140,315

[45] Date of Patent: Aug. 18, 1992

[54] ANTIALIASED PIXEL BASED DISPLAY SYSTEM FOR LINES AND SOLIDS

[75] Inventors: Steven D. Edelson, Wayland; Larence Bodony, Waban, both of Mass.; Gary Frattarola, Merrimack; Stewart Bailey, Nashua, both of N.H.

[73] Assignee: Analog Devices, Inc., Norwood, Mass.

[21] Appl. No.: 509,177

[22] Filed: Apr. 16, 1990

[51] Int. Cl.[5] ..... G09G 1/16

[52] U.S. Cl. ..... 340/728; 340/703; 340/723; 340/744

[58] Field of Search ..... 340/701, 703, 723, 728, 340/742, 744, 747, 750, 731; 382/31, 54; 358/80; 395/131, 132, 142, 143

[56] References Cited

U.S. PATENT DOCUMENTS

| | | | |
|---|---|---|---|
| 4,586,037 | 4/1986 | Rosener et al. | 340/728 |
| 4,591,844 | 5/1986 | Hickin et al. | 360/728 |
| 4,704,605 | 11/1987 | Edelson | 340/728 |
| 4,849,746 | 7/1989 | Dubner | 340/728 |
| 4,991,122 | 2/1991 | Sanders | 340/701 |

*Primary Examiner*—Ulysses Weldon
*Assistant Examiner*—Jick Chin
*Attorney, Agent, or Firm*—Lane, Aitken & McCann

[57] ABSTRACT

In a pixel based color display system, aliasing is minimized by controlling the colors in pixels, bridging boundaries of objects of the image to be blends of the colors on each side of the boundary. Blends are controlled in accordance with pixel words containing mix values. Provision is made for drawing lines one pixel line with aliasing minimized in the boundaries of the lines wherein the same mix value controls the blend in adjacent pixels bridging the leading and trailing edge of a diagonal line.

19 Claims, 4 Drawing Sheets

ANTIALIASED PIXEL BASED DISPLAY SYSTEM FOR LINES AND SOLIDS

This invention relates to an edge smoothing system for reducing the artifacts caused by aliasing in pixel based displays and, more particularly, to an edge smoothing system designed to operate on pixel based displays including lines which are one pixel wide.

BACKGROUND OF THE INVENTION

In pixel based display systems, a display screen is divided into incremental components called pixels and the display of a color image is controlled by controlling the color of each pixel in the display. State of the art pixel display systems make use of a random access memory called a palette RAM as a look up table storing in its address locations different possible colors to be displayed in each of the pixels in the display device. Each location in the palette RAM stores three binary bytes which in combination represent a color. For example, the three bytes may represent the red, green and blue intensity components of the color. Alternatively, the three binary bytes may represent the color by values representing hue, brightness, and saturation or in the YIG color representing system. To cause a given pixel to be displayed with a selected color, the storage location in the palette RAM containing the color must be read out causing the stored bytes to be applied to digital-to-analog converters converting the color values to analog signals which become video signals. The palette RAM is part of a pixel decoder palette, also known as a RAMDAC, which receives pixel words representing palette RAM addresses in sequence, reads the color information out from the address locations selected by the received addresses, and converts the output signals read out from the palette RAM to the video signals to be applied to the video display device.

In conventional pixel display systems, each pixel displayed must be one of the colors selected from the palette RAM. As a result, the edge of any object being displayed must always be displayed as occurring at the boundary between pixels. When an object edge is in the form of a diagonal line extending across the display screen, the object will appear distorted as a stair step or jagged edge. The eye is particularly sensitive to such stair step distortion and even when a large number of pixels are used to represent an object, the eye will perceive a diagonal line as a jagged edge. This artifact of pixel based displays is called aliasing.

U S. Pat. No. 4,704,605 issued Nov. 3, 1987 to Steven D. Edelson, a coinventor of this application, discloses a system for smoothing the edges forming the boundaries between objects in pixel based displays to minimize the effect of aliasing. As described in this patent, each pixel through which a boundary or edge passes is controlled to display a color which effectively mixes the colors on each side of the boundary in amounts corresponding to where in the pixel the boundary occur. By mixing the colors in the boundary or edge bridging pixels in this manner, the jaggedness of the edge as perceived by the viewer is substantially minimized. This method of reducing aliasing is referred to as continuous edge graphics.

In one of the embodiments described in the Edelson patent, called the pixel divide mode of operation, each pixel word is divided into two parts, one part representing color and the other part representing a mix value indicating how much of each color on each side of a boundary is to be blended in the pixel which bridges the boundary. This technique was effective in representing color displays having fine detail, but greatly limited the number of pure colors that could be displayed as object colors. In accordance with a second embodiment of the invention described in the Edelson patent, certain pixel words above a predetermined value were reserved as mix values and only the pixel words having values below the mix values represented color. Whether a pixel word represented the address of a color or represented a mix value Was determined by whether the pixel word value exceeded the predetermined value. In this embodiment, the pixel word corresponding to the pixel preceding the edge of an object represented the color of that object, and the mix value was represented in the pixel word which corresponded to the pixel bridging the object edge. This latter system, which is called the pixel delay mode of operation, worked very well for large objects with adequate spacing between edges, but it imposed severe limitations on drawing thin lines because each object edge required at least two pixels, whereas in computer raster graphics, lines are normally drawn to be just one pixel wide. When a line one pixel wide is not aligned with a pixel, it will lie partially in one pixel and partially in a neighboring pixel. To ideally represent these lines with the artifact of aliasing minimized, the two pixels bridging a line should each contain blends of the line color and the background color on each side of the line with the blends corresponding to the amount of each of the two pixels that the line occupies. Intuitively, it would seem that three pixels would therefore be required to represent a line which is not aligned with a pixel, one to represent the line color and two to represent the mix values for each line edge. Also, each line would have to be separated by one pixel of background color which forms a barrier to drawing lines in close proximity to one another. In line drawing applications, it is desirable to have lines at arbitrary spacings or even abutting one another. The present invention is to provide an edge smoothing or antialiasing system which is effective with line drawing systems and permits lines to be drawn in close proximity to one another.

SUMMARY OF THE INVENTION

The present invention, which is a modification of the pixel delay mode described in the Edelson patent, takes advantage of special properties of lines to implement a protocol to draw a line with edge smoothing employing only two pixels to represent a line. The present invention makes use of the fact that a line has the unique property of being only one pixel wide. As a result, a line which is not aligned with the pixel will cover complementary percentages of two adjacent pixels in which the line is found. For example, if the line occupies 70 percent of the first pixel, then it will occupy 70 percent of the adjacent pixel. Because of this feature of a line, it can be represented in only two pixels, one pixel representing the color of the line and the other pixel representing a mix value. If the mix value for the leading edge of the line is 70 percent, meaning that 70 percent of the background color is to be blended with 30 percent of the line color, then this same mix value of 70 percent can be used to determine the amount of line color to be blended with 30 percent of the background color on the trailing edge of the line. Thus, the percentages to be used in the pixel bridging the leading and trailing edges can be determined by a single mix value. In accordance with the invention, the need for providing a pure color value between mix values when lines are close together is overcome by implementing a system of background colors and foreground colors. When two or more pixels of the same pure color appear in a row, a background color is established. Fewer than two pixels in a row do not change the background color so that a line may be drawn on a foreground color. Lines composed of single color pixels and mixes do not affect the background color since the background color is intact after mix values representing lines occur. The requirement to place a pixel of background color between lines is eliminated and, thus, lines can be represented in close proximity to one another. To distinguish lines from edges of large objects, lines are always represented by a sequence of pixel words in which either a single mix value is surrounded by pixel words representing color values or a single pixel word representing a color value is surrounded by mix values. An edge between large objects will always be represented by at least two pixel words in a row representing colors followed by at least two mix values. In order to respond to the various sequences in which lines in close proximity can be recognized and distinguished from background color, hardware is provided which enables the system to keep track of the pixel word history for several pixels in a row, so at any given time, the system can respond to a combination of pixels in sequence.

DESCRIPTION OF THE PREFERRED EMBODIMENT

Figure 1:
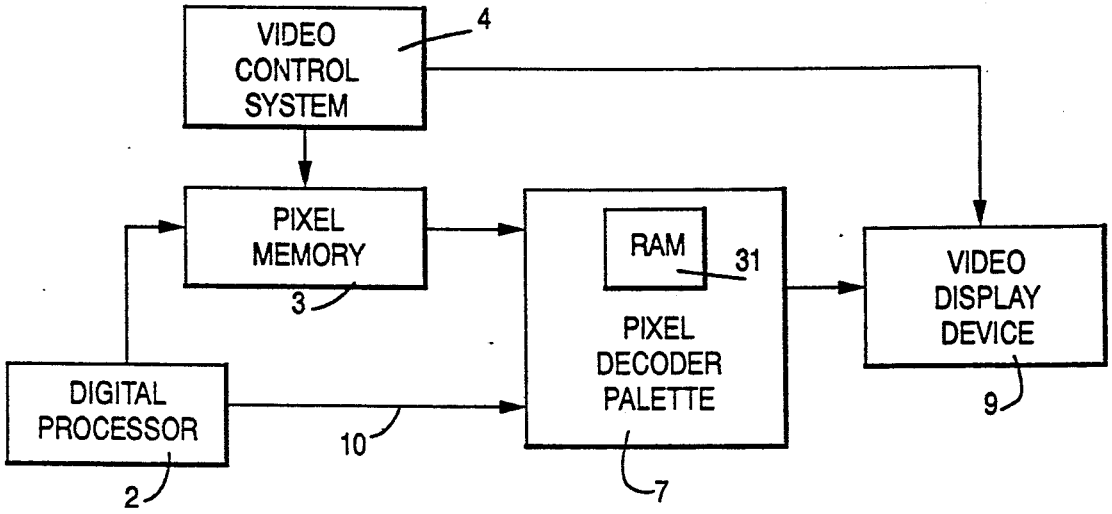
FIG. 1 is a block diagram illustrating the system in which the invention is employed.

In the system of the invention as shown in FIG. 1, a digital processor 2 generates display data in the form of pixel words which are stored in a pixel memory 3. The pixel memory 3 stores pixel words representing an entire display frame of pixels representing a video frame to be displayed in pixels. Each pixel word stored in the pixel memory can control the color of a corresponding displayed pixel in the frame to be displayed. A video control system 4 reads the pixel words stored in the pixel memory 3 in sequence and applies them to a pixel decoder palette 7 which is implemented in a single integrated circuit chip. The video control system 4 applies video scanning signals directly to a color video display device 9 in synchronism with the pixel words as they are read out of pixel memory 3. In response to the applied pixel words, the pixel decoder palette generates red, green and blue video signals, which are applied to the video display device 9, which reproduces the image represented by the pixel words stored in the pixel memory.

The pixel decoder palette contains a RAM 31, which is a look-up table having a large number of storage locations, e.g., 256 locations, each capable of storing three 8-bit bytes which represent the components of a color. As in a conventional pixel display system, a series of pixel words representing addresses in the RAM 31 are applied in sequence to the pixel decoder palette 7 from the pixel memory 3 to read out the color values from the corresponding address locations in the RAM 31. The pixel words are applied to the address port of the palette RAM 31 in synchronism with the raster scan of the video display device 9. As the color values are read out, they are converted to analog values which are applied to the display device 9 as video signals to generate a color image. Thus, by selecting the pixel words, the color of each pixel can be controlled.

With the system described above, it will be apparent that the color of a component in a displayed image may be changed simply by changing the data in a memory location in the RAM 31. In the system shown in FIG. 1, the processor 2 can communicate with the pixel decoder palette 7 via I/O channel 10 and is operable to read out the colors stored in the palette RAM 31 on the I/O channel 10 or to store new colors in selected memory locations in the RAM 31 to thereby change the colors of different components in an image being displayed by the pixel words currently stored in the pixel memory 3.

Figure 2A:
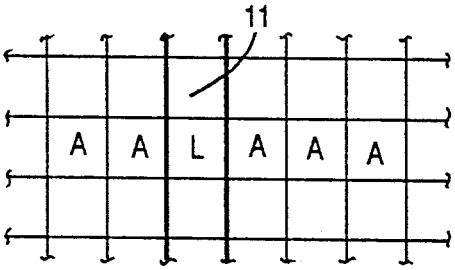
FIGS. 2A through 2F illustrate different examples for representing edges and drawing lines with the continuous edge graphic system of the present invention.
Figure 2B:
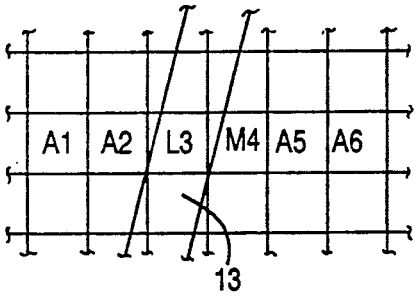

In the pixel display system of the present invention, lines to be displayed are considered to be one pixel wide. When the display is of a vertical line 11 of color L aligned with the pixels of the display on a background color A, as shown in FIG. 2A, then the sequence of horizontal pixels through which the line passes have the following colors, A, A, L, A, and A. Thus, a sequence of pixel words selecting this sequence of colors from the RAM 31 will produce the desired display. The problem arises when the line is not vertical, such as a diagonal line shown in FIG. 2B. In FIG. 2B, the line 13 is again of the color L and it is being reproduced on a color background A. In accordance with the present invention, this line will be represented in a horizontal line of pixels by a sequence of pixel words A1, A2, L3, M4, A5, and A6, in which A1, A2, A5, and A6 are pixel words containing the address of the color A, L3 is a pixel work containing the address of the color L, and M4 is a pixel word representing a mix value. The fact that the sequence of pixel words contains a single mix value surrounded by colors indicates that the sequence of pixel words represent the display a diagonal line. Assuming that the sequence of horizontal pixels are numbered 1, 2, 3, 4, 5, and 6, then A1, A2, A5, and A6 are pixel words determining the color of the pixels 1, 2, 5, and 6, respectively. The line is represented by pixel words L3 and M4 and the presence of the mix value in the pixel word M4 corresponding to pixel number 4 indicates that the line passes through pixel number 3 and pixel number 4 as shown in FIG. 2B. Thus, the pixel number 3 bridges the leading edge of the line and the pixel number 4 bridges the trailing edge of the line. The pixel word L3 represents the address of the color L of the line and the mix value M4 indicates the percentage of the color A to be mixed with a complementary percentage of the color L in pixel number 3 bridging the leading edge. The pixel number 4 bridging the trailing edge of the line will also contain a blend of the colors L and A and the same mix value M4 is used to represent the percentage of color L to be mixed with a complementary percentage of the color A in pixel number 4. For example, the mix value M4 in the example is FIG. 2B could represent 20 percent meaning that 20 percent of the color A is to be mixed with 80 percent of color L in pixel number 3 bridging the leading edge of the line. This means that pixel number 4 bridging the trailing edge of the line must have 20 percent of the color L mixed with 80 percent of the color A. Thus, the same mix value determines the blend for both the leading and trailing edges.

The same hardware will produce the desired results if the line shown in FIG. 2B, instead of being on a background of color A, is on the edge of an object containing the color B. In this instance, the colors on the right-hand side of the line will contain the value of the color B instead of the color A. The same mixing procedure will produce the desired colors. Twenty percent of the color A would be mixed with 80% of the color L in pixel number 3 and then 20 percent of the color L would be mixed with the color B in pixel number 4.

Figure 2C:
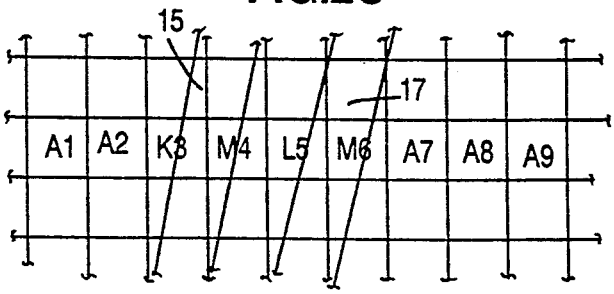

When two lines are displayed close together as shown in FIG. 2C, the system makes use of the foreground and background color aspect of the present invention to generate a row of horizontal pixels to depict lines 15 and 17 In this case, the background color is A, which is established by the fact that the color A occurs for at lest two successive pixels before the lines 15 and 17 are encountered. The sequence of pixel words for representing this example A1, A2, K3, M4, L5, M6, A7, A8, and A9 in which A1, A2, A7, A8, and A9 are addresses of the background color A, K3 is the address of the line color K of the line 15, and L5 is, the address of the line color L of the line 17. M4 is a mix value determining the percentages to be blended in the leading and trailing edges of the line 15 in pixel number 3 and pixel number 4 and M6 is a mix value determining the percentages of colors to be blended in the leading and trailing edges of the line 17 in pixel number 5 and pixel number 6. M4 indicates the percentage of the color A to be mixed with complementary percentage of the line color K in pixel number 3 bridging the leading edge of the line 15. M6 represents the percentage of the background color A to be mixed with a complementary percentage of the line color L in the pixel 5 bridging the leading edge of the line 17. Because the mix values M4 and M6 are single mix values surrounded by pixel words representing colors, they are recognized as representing lines. Because only one pixel word L5 representing a color occurs between the two mix values M4 and M6, the background color remains the color A. As a result, the mix value M6 will determine the percentage of the color A to be mixed with a complementary percentage of the color L in the pixel number 6 bridging the leading edge of the line 17. The pixel number 5 bridging the trailing edge of the line 15 will be a blend of the color A mixed with the color K with the mix value M4 determining the percentage of the color K to be mixed with a complementary percentage of the color A.

Figure 2D:
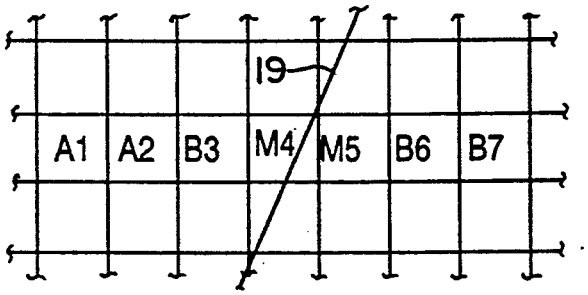

FIG. 2D illustrates the way the system represents the boundary between two large objects in a horizontal row of pixels, when no line one pixel wide is involved in the display. In FIG. 2D, the object to the right of the boundary 19 has the color B and the color to the left of the boundary as the color A. The boundary passes through pixel number 4 in a sequence of pixels numbered 1–7 corresponding to the pixel words A1, A2, B3, M4, M5, B6 and B7, in which the pixel words A1 and A2 represent addresses of a color A, B3, B6 and B7 represent addresses of the color B, and M4 and M5 are mix values. The fact that the display being represented is a boundary between large objects is indicated in the sequence of pixel words by at least two sequential mix values, which are preceded by two color pixel words. The mix value M4 determines the percentage of the color A to be mixed with the complementary percentage of the color B in the pixel number 4 bridging the boundary 19. In the specific example of FIG. 2D, the pixel 5 does not contain any of the color A to be blended with the color B. Yet, the pixel 5 must be represented by a mix value to indicate the presence of a boundary between large objects. Accordingly, to make pixel 5 have the color B, the mix value M5 is made zero so that it indicates a zero percentage of the color A to be blended with the color B in pixel number 5. Also, the fact that two mix values M4 and M5 occur in sequence causes pixel number 3 to have the background color A rather than the new color B in response to the pixel word B3. Essentially, the system representing a boundary between two large objects is the same system used in the pixel delay mode described in the Edelson patent, except that two mix values in a row are always used to represent a boundary between two large objects so as to distinguish a pixel word sequence representing such a boundary from a pixel word sequence representing one or more lines.

Figure 2E:
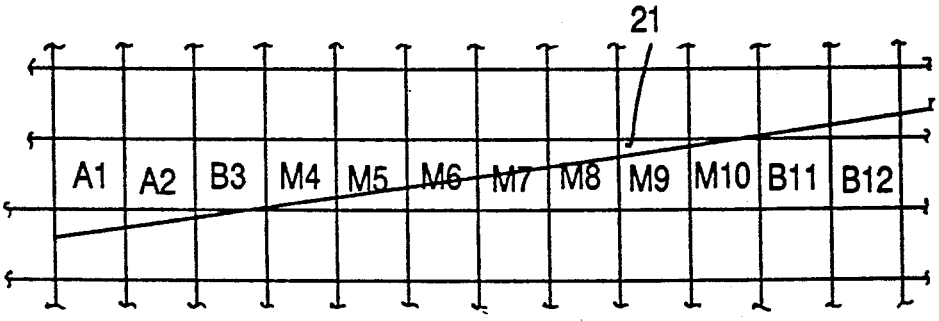
Figure 2F:
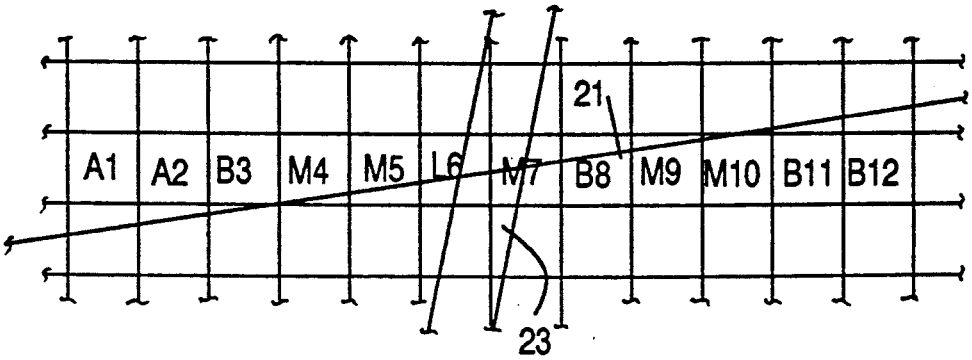

Using the scheme of representing a line by a pair of pixel words, the first one being the address of a color corresponding to the pixel bridging the leading edge of the line and the second being a mix value corresponding to the pixel bridging the trailing edge of the line will result in a single color value being surrounded by mix values for the situation in which a nearly vertical line intersects a nearly horizontal boundary. This situation is illustrated in FIGS. 2E and 2F. FIG. 2E shows the arrangement for representing a nearly horizontal boundary. As shown in this figure, the color above the nearly horizontal boundary 21 separating two large objects is A and the color below the boundary 21 between the two large objects is B. As shown in FIG. 2E, the display for the boundary 21 is represented by a sequence of pixel words A1, A2, B3, M4, M5, M6, M7, M8, M9, M10, B11 and B12 corresponding to pixels numbered 1–12. In this sequence of pixel words, A1 and A2 are each the address of color A, B3, B11 and B12 are each the address of the color B, and M4 through M10 are mix values. The system will recognize this sequence of pixel words as representing a boundary between large objects because the pixel word sequence contains at least two mix values in a row preceded by two color pixel words. Accordingly, the system will recognize the pixel word B3 as representing the new color following the boundary and will maintain the color A in the pixel number 3 preceding the boundary edge. The system will use the color B as the new color to be mixed with the old color in accordance with the mix values M4 through M10 in the pixels bridging the boundary A complication arises when a line 23 crosses a horizontal boundary 21 such as shown in FIG. 2F. As shown in this figure, a pixel word L6 representing the address for the color L of the line 23 for the pixel number 6 at the intersection of the line with the horizontal boundary has replaced the mix value M6. In addition, the pixel word M7 will have a different value than in FIG. 2E. The color pixel word L6 and the mix value M7 are the pixel word pair representing the line 23. This pixel word sequence is recognized as an indication that there is a line intersecting a generally horizontally extending boundary The system will display the pixels numbered 1 through 5 as in FIG. 2E. However, in response to the presence of the single color pixel word L6 surrounded by mix values, the system will represent the pixel number 6 bridging the leading edge of the line 23 at its intersection with the boundary 21 as a blend of the background color A with the line color L with the percentage of A being determined by the mix value M7. Then in pixel number 7 bridging the trailing edge of the line 23, the color L is blended with the background color A in accordance with the mix value M7 with the percentage of the color L determined by M7.

The pixel word B8 serves to reset the foreground color to the color B so that in pixel 9, a percentage of the background color A determined by the mix value M9 will be blended with a complementary percentage of the color B. Since the pixel word B8 has replaced the mix value M8, the mix value M8 is not available to determine the blend in pixel number 8. It is not desirable to use the blend in pixel number 7 to determine the color of pixel 8 because this would have the effect of appearing to smear the line color to the right in the display Instead, the system produces in pixel number 8 the same blend that is produced in pixel 9.

To represent the lines and take care of the special situations described above, the hardware of the present invention is designed to implement seven logical rules making use of two registers, one called the new color register and the second called the old color register.

Rule 1 occurs whenever a color pixel word is followed by a second color pixel word. This color sequence occurs in the middle of a large object which by definition is a background color. When the current pixel word represents a color and is followed by at least one color pixel word, then the system places the color represented by the current pixel word in the new color register and places the color Which was in the new color register in the old color register. In addition, the system displays the color which is placed in the new color register Rule 2 is implemented when the current pixel word represents a color value and is surrounded by mix values, that is, it is followed by at least one mix value and the current pixel word is preceded by at least one mix value. This sequence of pixel words occurs for the situation illustrated in FIG. 2C and 2F. In FIG. 2C, the color pixel word L5 is proceeded and followed by a mix value. In FIG. 2F, the pixel words L6 and B8 are each surrounded by mix values. When this rule applies, the system retains the color that was in the old color register in the old color register and the current color is stored in the new color register The system displays a percentage of the color in the old color register blended with a complementary percentage of the color in the new color register with the percentage determined by the succeeding mix value. When this rule is applied to pixel number 5 in FIG. 2C, the color L represented by the pixel word L5 is the current color which is stored in the new color register. The color A is retained in the old color register and the mix value M6 determines the percentage of the color A to be blended with a complementary percentage of the color L and displayed in pixel number 5. In the situation shown in FIG. 2F, the color A is retained in the old color register for both pixel number 6 and pixel number 8. For pixel number 6, the system stores the color L in the new color register an displays a percentage of the color A determined by the mix value M7 blended with a complementary percentage of the color L. For pixel number 8, the color B is stored in the new color register and mix value M9 determines the blend, which is the same blend that will be produced in pixel number 9 as is desired.

Rule 3 is implemented when a color pixel word is followed by one mix value and no more than one mix value and the color pixel word is preceded by one or more color pixel words. This situation occurs when the current pixel word value corresponds to a pixel bridging the leading edge of a nearly vertical single line, such as the pixel word L3, as shown in FIG. 2B or corresponds to a pixel bridging the leading edge of a first one of a plurality closely adjacent nearly vertical lines, such as the pixel word K3 in FIG. 2C. When this rule is called, the color that was in the new color register is transferred to the old color register, the current color is stored in the new color register, and a percentage of the color in the old color register blended with a complementary percentage of the color in the new color register is displayed. The percentage of the old color is determined by the mix value in the pixel word following the pixel word containing the current color value. This rule causes the correct blend of colors to be displayed in pixel number 3 bridging the leading edge of the line 13 shown in FIG. 2B and in pixel number 3 bridging the leading edge of the line 15 illustrated in FIG. 2C. When this rule is applied to pixel number 3 in FIG. 2B, the current color L represented by the pixel word L3, is stored in the new color register and the color A is transferred from the new color register to the old color register. A percentage determined by the mix value M4 of the old color A is blended with a complementary percentage of the new color L and is displayed in pixel 3.

Rule 4 is implemented whenever the current pixel word represents a color value and it is followed by at least two mix values and the current pixel word is preceded by at least one color pixel word. This rule is called into effect when the current pixel word corresponds to a pixel preceding the edge of a large object such as the pixel word B3 in FIG. 2D. When this rule is called, the color value that was in the new color register is moved to the old color register and the color value of the current pixel word is stored in the new color register. The color displayed will be the color displayed in the previous pixel. When this rule is applied to pixel 3 in FIG. 2D, the color B represented by the pixel word B3 will be stored in the new color register and the color A will be transferred from the new color register to the old color register. The color displayed in pixel number 3 will be the color A since this was the color displayed in previous pixel number 2.

Rule 5 is implemented when the current pixel word is a mix value in a sequence of two or more mix values; that is, the current pixel word is preceded by or followed by a mix value or both. This rule is called into effect for a pixel bridging the edge of a large object as represented by the pixel words containing the mix values M4 and M5 in FIG. 2D or mix values M4 through M10 in FIG. 2E. Whenever this rule is invoked, the colors already in the old and new color registers are retained. The system displays a blend of the colors in the old and new color registers in accordance with the mix value in the current pixel word; that is, the mix value determines the percentage of the old color to be mixed With a complementary percentage of the new color.

Rule 6 is invoked whenever the current pixel word is a mix value and it is followed by a color pixel word followed in turn by a mix value and the current pixel word is preceded by at least one color pixel word. This situation occurs when two nearly vertical lines are being displayed close together as shown in FIG. 2C. The mix value M4 is preceded by a color pixel word K3 and is followed by a color pixel word L5 followed in turn by a mix value M6. This situation also occurs in the situation shown in FIG. 2F wherein the mix value M7 is preceded by color pixel word L6 and is followed by a color pixel word B8 followed in turn by mix value M9. When this rule is implemented, the foreground and background colors are kept the same, meaning that the color that was in the new color register is retained and the color that was in the old color register is retained and a blend of the old colors and new colors is displayed. However, the amount of the old color to be mixed with the new color is determined by the complementary value of the percentage represented by the current mix value. The system uses a value called the antimix to determine the percentage to use in the blend calculation. When this rule is applied in pixel number 4 in FIG. 2C wherein M4 is the current pixel word, the antimix value of the mix value M4 will determine the percentage of the background color A in the old color register to mix with the foreground color K in the new color register. Thus, the color for the pixel number 4 bridging the trailing edge of the line 15 is correctly displayed. Similarly, for the situation illustrated in FIG. 2F, when the current pixel word contains the mix value M7, the antimix of the value M7 will be used to determine the percentage of the background color A to be blended with the foreground color L and, in this manner, the correct blend of colors is displayed for the pixel number 7 bridging the trailing edge of the line 23.

Rule 7 is invoked whenever a mix value is followed by two or more color pixel words and the mix value is preceded by at least one color pixel word. This rule is invoked for pixel number 4 bridging the trailing edge of the line 13 shown in FIG. 2B when the pixel word containing the mix value M4 is the current pixel word. It is also invoked for pixel number 6 bridging the trailing edge of the line 17 in FIG. 2C when the current pixel word contains the value M6. When this rule is invoked, the color in the new color register is transferred to the old color register and the color following the current pixel word inserted into the new color register. The mix value then determines the percentage of the color in the old color register to be mixed with a complementary percentage of the color in the new color register. In this manner, pixel number 4 bridging the trailing edge of the line 13 as shown in FIG. 2B is correctly displayed with the right amounts of the line color L in the old color register to be blended with the color A in the new color register. Similarly, for pixel number 6 bridging the trailing edge of the line 17, the mix value M6 determines the percentage of the line color L to be mixed with a complementary percentage of the color A.

Figure 3:
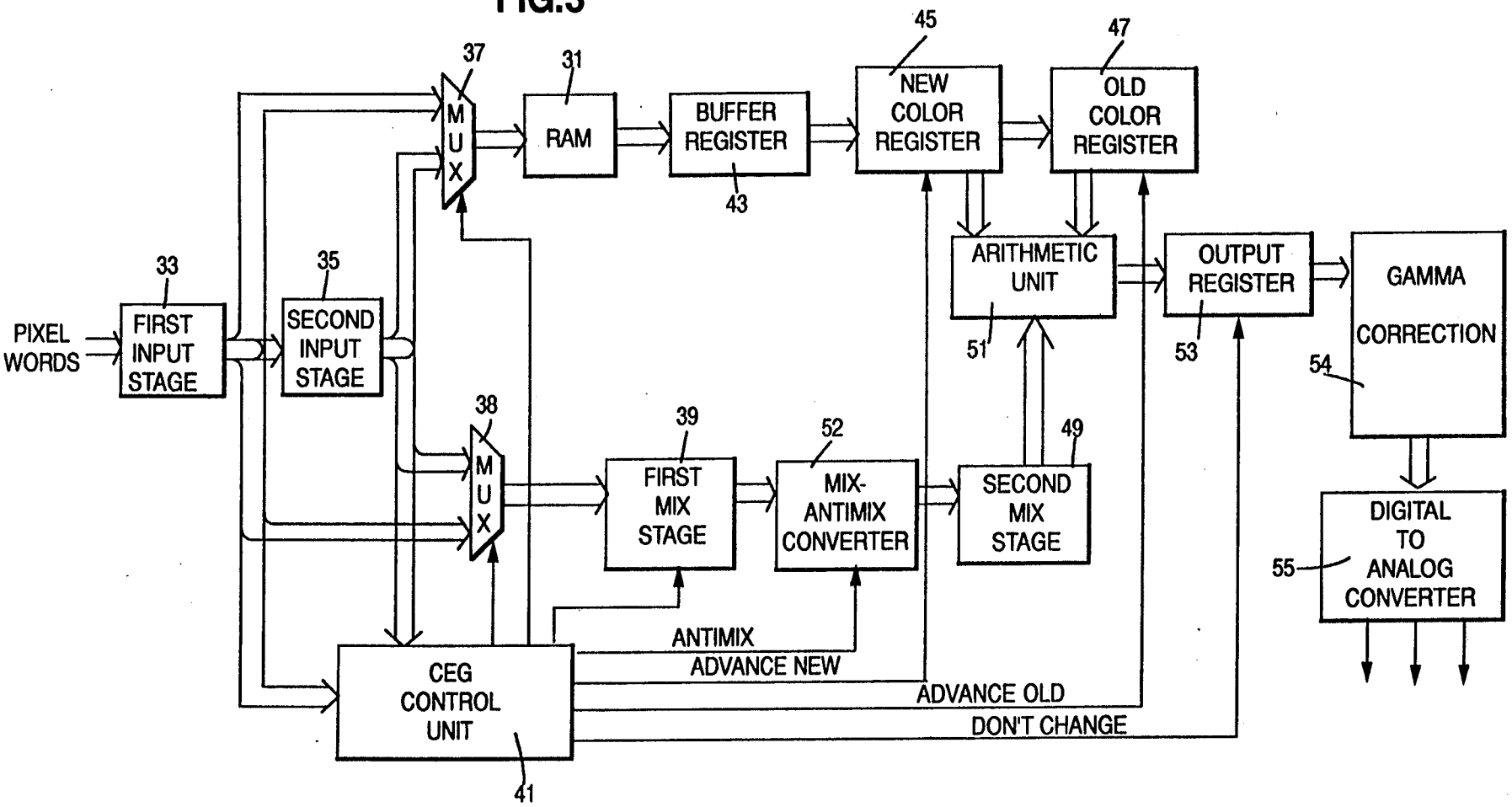
FIG. 3 is a block diagram of the hardware employed in the pixel decoder palette of the present invention.

The hardware for implementing the rules 1-7 is shown in FIG. 3, which illustrates the details of the pixel decoder palette 7. As shown in this figure, the pixel words representing addresses in the RAM 31 or mix values are fed in sequence to an input stage 33 in synchronism with pixel clock pixels. From the input stage 33, they are advanced to a second input stage 35 one pixel clock pulse later. From stages 33 and 35, the pixel words can be transmitted to the input port of the RAM 31 or registered in the first stage 39 of a mix value pipeline. The selection of values from stage 33 and stage 35 to be fed to the input port of the RAM 31 or the first stage 39 of the mix value pipeline is controlled by the CEG control unit 41, which detects and responds to the values in stages 1 and stages 2 and keeps track of the history of the values that were in stage 2 for three successive pixel word clock periods. By responding to the current conditions of input stages 33 and 35 and the history of the pixel data in stage 35 for three successive pixel clock periods, the CEG control unit can respond to a sequence of five pixel words. The CEG control unit detects whether a given pixel word is a mix value or represents a color value by whether or not the numerical value of the pixel word is above or below 224. If the address is in the range from 224 to 255, then the pixel word contains a mix value and the percentage represented by the mix value is determined by the five least significant bits of the pixel word. If the pixel word represents an address of zero to 223, then the pixel word is a color pixel word representing a color value.

The control unit 41 by controlling the multiplexers 37 and 38 steers the outputs from the input registers 33 and 35 to the input port of the RAM 31 or into the register 39 so that the pixel words representing color values are steered to the input port of the RAM 31 and input values representing mix values are registered in the register 39, which is the first stage of the mix value pipeline. If there is a mix value in input stage 33, and a color pixel word in the input stage 35, the color pixel word in the register 35 will be gated through the multiplexer 37 to the input port of the RAM 31 and the mix value in input stage 33 will be gated through the multiplexer 38 to be registered in the register 39 in the next pixel clock time. If there are color pixel words registered in both registers 33 and 35, the control unit 41 causes a value of zero w[11 be stored in the register 39 and the color pixel word in the register 35 will be gated into the input port of the RAM 31 If there are mix values in both input registers 33 and 35, then the mix value in the input register 33 will be gated into the input stage 39 of the mix value pipeline in the next pixel clock time. The control unit 41 achieves this steering by normally gating the contents of the second input stage 35 to the input port of the RAM 31 and the contents of the first input stage 33 into the input stage 39 of the mix value pipeline and when a mix value is registered in the second input stage 35, this gating is reversed so that the value in the first input stage 33 is gated into the input port of the RAM and the contents of the second input stage 35 is gated into the input stage 39 of the mix value pipeline. However, as pointed out above, when both input registers 33 and 35 contain a color pixel word, then a mix value of zero will be inserted in the input stage 39 of the mix value pipeline.

In this manner, mix values get steered into the mix value pipeline and color pixel words get steered into the input port of the RAM 31. This arrangement will cause a mix value to get steered into the input port of the RAM 31 when mix values occur adjacent to one another resulting in mix values being stored simultaneously in both registers 33 and 35. However, such action has no effect on the display as will be explained below.

Each time a color pixel word is applied to the input port of the RAM 31, the RAM 31 will read out a 24 bit value into an output buffer register 43. The 24 bit value will come from the storage location selected by the address contained in the applied pixel word and will contain values representing a color to be displayed. Eight bits of the twenty-four bit value will represent the red intensity, eight bits of the twenty-four bit value will represent the blue intensity and eight bits of the value will represent the green intensity of the color. These values are stored in the register 43 in the next pixel clock time following the storage of the pixel word in the register 33 or the register 35 from which the pixel word was applied to the input port of the RAM 31. In the next following pixel clock time, the color values stored in the register 43 may be advanced into the new color register 45 under the control of control unit 41. Alternatively, the control 41 may maintain the color in the new color register 45 the same color that it was. In the next pixel time following the registration of the color values in the new color register 45, the color values stored in this register may be advanced and stored in the old color register 47 under the control of the control unit 41. Alternatively, the control unit 41 may maintain the value previously stored in the old color register 47 that was previously stored in this register.

In the next pixel clock time following the storage of a mix value in the register 39, including in those instances when a mix value of zero is stored in the register 39, the mix value is advanced into the next stage 49 of the mix value pipeline passing through antimix converter 52 which is explained below.

In each pixel clock period, the arithmetic unit 51 makes a computation making use of the values in the new color register 45, the old color register 47 and in the second stage 49 of the mix value pipeline. This computation is as follows:

$$MC_O+(1-M)C_N$$

in which M is the percentage represented by the mix value, $C_O$ is the color in the old register, and $C_N$ is the color in the new color register. This computation is done for each of the three intensity values stored in the registers 45 and 47 and the results of the computation are registered in an output register of the arithmetic unit 51. It will be noted that the formula for producing the mix values can be simplified and reduces to the following:

$$M(C_O-C_N)+C_N$$

Thus, the arithmetic unit 51 needs merely to subtract the color in the new color register 45 from the value in the old color register 47, multiply this difference times a mix value applied by the second mix stage 49, and add the resulting multiplicand to the value in the new register to get the desired blends. It will be recalled that each color is represented by three color components, the red, green and blue intensities and the arithmetic unit comprises three separate circuits performing the three arithmetic calculations simultaneously to produce three separate 8-bit outputs to be stored at the 24-bit output of the arithmetic unit 51.

The mix value applied to the arithmetic unit 51 from the second mix stage 49 is a 5-bit number obtained from the five least significant bits of the pixel word representing the mix value. Thus, the mix value ranges from zero to 31 representing percentages from 0 to 97 percent as employed in the calculations of the arithmetic unit 51. It will also be apparent that if the mix value is zero, as will be the case in response to the input registers 33 and 35 both containing color values, the value computed and stored in the output register of the arithmetic unit 51 will be the pure new color value. This is the mechanism by which the system of the invention generates pure color values, that is, colors for pixels which do not bridge boundaries of objects or lines. In the next pixel time after the intensity values are registered in the output register of the arithmetic unit 51, they are registered in output register 53 except when the control unit 41 signals the register 53 to retain the value that it stored in the previous clock period.

The antimix converter 52 normally passes the five bit mix value into the second mix pipeline stage 49 without modification. However, when the control unit 41 applies the antimix signal to the antimix converter 52, it converts each bit of the five-bit binary number to its complement, which is the antimix value and which on a scale of 0 to 32 will represent the complementary percentage of the percentage represented by the mix value. Thus, when the antimix signal is generated, the antimix of the mix value stored in register 39 will be stored in register 49 in the next pixel clock time. The antimix converter 52 is implemented by a set of five exclusive OR gates each receiving one of the five bits of the mix value as one input and receiving the antimix signal as the other input so that each gate transmits the corresponding bit of the mix value when the antimix signal is not present and transmits the opposite bit value when the antimix signal is present. In this manner, the mix value is converted to its complementary 5-bit binary value by the antimix converter 52.

By means of the control signals applied to the registers 45, 47 and 53 determining whether or not the color value from the previous register is to be stored or the previous color value retained in these registers, and the antimix signal, the hardware system effects the seven rules to achieve the desired mixing for lines and objects as described above. As pointed out above, the CEG control unit 41 responds to specific sequences of mix values and color pixel words in the pixel word sequence. To facilitate the description of the control unit function, the sequences will be represented by the letters C, M and X in which C represents a color pixel word, M represents a pixel word containing a mix value and X represents a pixel word which may be either a color pixel word or a mix value. The CEG control unit responds to three specific pixel word sequences to advance both the new color register 45 and the old color register 47 so that the intensity values registered in the output buffer 43 are stored in the new color register 45 and the color value stored in the new color register 45 are advanced to the old color register 47. These pixel word sequences are as follows:

CCXX

MXCCX

CMCC

These specific sequences cause the generation of advance new and advance old signals when the last pixel word of one of these sequences is registered in the first input stage 33 and the generated signals are effective to cause the advance of new colors into the register 45 and 47 in the next pixel clock time. The advance new signal, when applied to the new color register 45, causes the color value stored in the output buffer 43 to be advanced into the new color register 45. The advance old signal causes the color value stored in the new color register 45 to be advanced into the old color register 47. In addition, the CEG control unit 41 will generate the advanced new signal to load the new register 45 with the intensity values in the register 43 whenever the sequence CMX occurs in the next clock pulse period following the registration of the last value of the sequence in the input stage 33. It will be apparent that in some instances, the advance new signal will be generated without the advance old signal being generated so that the intensity values stored in the register 43 are advanced to and stored in the new color register 45, but the values previously stored in the old color register 47 are retained in the old color register 47. The CEG control unit 41 also generates a don't change signal, which is applied to the output register 53 and causes the value that was previously stored in this register to be retained. Otherwise, the value in the output of the arithmetic unit 51 is advanced into the output register 53 in each succeeding clock pulse period. In those clock pulse periods, when the don't change signal is generated, the value at the output register 53 is retained. The don't change signal is generated in response to the sequence CCMM when the last pixel word of this sequence is stored in the input stage 33 and is pipelined to be applied to the output register 53 two pixel clock times later.

To implement some of the above rules, notably Rule 6, it is necessary for the blend to be displayed to be computed as a percentage of the color in the new color register and a complementary percentage of the color in the old color register, instead of vice versa as in most of the rule implementations. To facilitate this calculation, an antimix value is generated, which is the complement of the mix value and this antimix value is used to determine the percentage used as the multiplier for the color value in the old color register to be blended with the complementary percentage of the value in the new color register. It will be recognized that this action is the equivalent of using the mix value to determine the percentage to be used as the multiplier times the new color value to be mixed with a complementary percentage of the old color value. The control unit changes the mix value to its complementary value by the antimix signal which is generated whenever the sequence CMCM occurs at the time the pixel word represented by the last pixel word in the sequence is registered in the input stage 33. When the antimix signal is generated, it converts the mix value to its complementary value in antimix convertor 52 when it is transferred from the first stage 39 of the mix pipeline to the second stage 49 of the mix pipeline.

The three 8-bit values representing a color stored in the output register 53 are applied to a gamma correction unit 54 which is a set of three look-up tables, one for each intensity value to provide gamma correction in a conventional manner. Each intensity value applied to the gamma correction circuit 54 selects an address location in the corresponding look-up table to be read out and thus produce a gamma corrected value. The gamma corrected values are applied to D/A convertors 55 which generate the signals to be applied to the video display device 9, as shown in FIG. 1.

The operation of the system will be better understood from considering the tables set forth below showing how the pixel words and the corresponding color values flow through the system as represented in FIG. 3. In the tables, the pixel words are given their same designations as in the illustrations of FIGS. 2A–2F. In addition, the color values read out from the palette RAM 31 and advanced through the buffer register 43, the new color register 45, the old color register 47, the arithmetic unit 51 and the output register 53 are designated by the same designation as the corresponding color pixel words. In addition, when a blended value appears at the output of the arithmetic unit 51 or in the output register 53, this value will appear in the table as the mix value designation. When a complementary value of the mix value is employed as the multiplier in the arithmetic unit 51, this fact is indicated by the corresponding mix value superscribed by a line. For example, the complementary value of M4 is designated by $\overline{M4}$.

Table 1 illustrates the situation when a stream of color pixel words are received by the system with no mix values as would be the case in the middle of a solid object or when a line is a vertical line and the line is aligned with the pixels in the display as shown in FIG. 2A. In Table 1, as in the other tables, it is assumed that the sequence of pixel words is preceded by several color pixel words.

TABLE 1

| | Pixel time | | | | | | | | | |
|---|---|---|---|---|---|---|---|---|---|---|
| | 1 | 2 | 3 | 4 | 5 | 6 | 7 | 8 | 9 | 10 |
| In. stg. 33 | A1 | A2 | L3 | A4 | A5 | | | | | |
| In. stg. 35 | | A1 | A2 | L3 | A4 | A5 | | | | |
| Buf. reg. 43 | | | A1 | A2 | L3 | A4 | A5 | | | |
| N.C. reg. 45 | | | | A1 | A2 | L3 | A4 | A5 | | |
| O.C. reg. 47 | | | | | A1 | A2 | L3 | A4 | A5 | |
| Mix stg. 39 | 0 | 0 | 0 | 0 | 0 | 0 | 0 | | | |
| Mix stg. 49 | | 0 | 0 | 0 | 0 | 0 | 0 | 0 | | |
| Arith. u. 51 | | | | | A1 | A2 | L3 | A4 | A5 | |
| Out. reg. 53 | | | | | | A1 | A2 | L3 | A4 | A5 |
| Adv. New | | | | 1 | 1 | 1 | 1 | 1 | 1 | |
| Adv. Old | | | | | 1 | 1 | 1 | 1 | 1 | |

As shown in Table 1, the first pixel word of the sequence A1 enters the input register 33 in pixel time 1, is advanced into register 35 in pixel time 2, and is applied to the input port of the RAM 31 in pixel time 2. Accordingly, in pixel time 3, the color Al will be advanced into the output register 43 and in pixel time 4, will be advanced into new color register 45. In pixel time 5, the color A1 will be advanced into the old color register 47. Since all of the pixel words are color pixel words, zeros will be entered into the mix pipeline stages 39 and 49 and be applied to the arithmetic unit 51. Since in pixel time 4, the value in register 45 will be the color A1 and the mix value will be zero as applied by the mix pipeline stage 49, the arithmetic unit upon making the calculation of $M(C_O-C_N)+C_N$ will produce the new color value A1 at the output of the arithmetic unit 51 in pixel time 5 and this color will be advanced into the output register 53 in pixel time 6. The remaining pixel words of the sequence and the corresponding colors advance through the system in the same manner as shown in the table, each passing through the corresponding stage of the system one pixel time later.

Table 2 illustrates what happens for the sequence of pixel words like that shown in FIG. 2B to represent a diagonal line represented by the pixel word sequence is A1, A2, L3, M4, A5, A6 and A7.

TABLE 2

| | 1 | 2 | 3 | 4 | 5 | 6 | 7 | 8 | 9 | 10 | 11 |
|---|---|---|---|---|---|---|---|---|---|---|---|
| 33 | A1 | A2 | L3 | M4 | A5 | A6 | A7 | | | | |
| 35 | | A1 | A2 | L3 | M4 | A5 | A6 | A7 | | | |
| 43 | | | A1 | A2 | L3 | A5 | A5 | A6 | A7 | | |
| 45 | | | | A1 | A2 | L3 | A5 | A5 | A6 | | |
| 47 | | | | | A1 | A2 | L3 | L3 | A5 | | |
| 39 | 0 | 0 | 0 | 0 | M4 | M4 | 0 | 0 | | | |
| 49 | | 0 | 0 | 0 | 0 | M4 | M4 | 0 | 0 | | |
| 51 | | | | | A1 | A2 | M4 | M4 | A5 | A6 | |

TABLE 2-continued

| | 1 | 2 | 3 | 4 | 5 | 6 | 7 | 8 | 9 | 10 | 11 |
|---|---|---|---|---|---|---|---|---|---|---|---|
| 53 | | | | | | A1 | A2 | M4 | M4 | A5 | A6 |
| A.N. | | | | 1 | 1 | 1 | 1 | 0 | 1 | | |
| A.O. | | | | | 1 | 1 | 1 | 0 | 1 | | |

As shown in Table 2, pixel words A1 enters input stage 33 at pixel time 1 and advances through the system as in Table 1 to have its color registered in the output register 53 in pixel time 6. The pixel word A2 advances through the system in a similar manner to be registered in the output register 53 in pixel time 7. The pixel word L3 enters the input stage 33 in pixel time 3 and the color L3 arrives in the new color register 45 in pixel time 6, at which time the color A2 will be registered in the old color register 47. In pixel time 4, the mix value M4 is registered in the input stage 33 and in pixel time 5, it is advanced into the first stage 39 of the mix pipeline in response to the condition of a color pixel word in stage 35 and a mix value in stage 33 in pixel time 4. Accordingly, in pixel time 6, the mix value M4 will be advanced into the second stage 49 of the mix pipeline. The mix value M4 in pixel time 5 will also be advanced into the second input stage 35 so that in pixel time 6, the mix value M4 will be duplicated in stages 39 and 49. As a result of the mix value M4 being in the stage 35 in pixel time 5, the pixel word A5 in stage 33 will be applied directly to the input port of the RAM 31 and the color A5 will be registered in the buffer register 43 in pixel time 6. At the same time, the pixel word A5 will be advanced into the input stage 35. As a result of the mix value, M4 being in the second stage 49 of the mix pipeline in pixel time 6, the arithmetic unit 51 will produce at its output a blend of the colors L3 and A2 stored in registers 45 and 47 with the mix percentage used in the formula being determined by the value of M4. The resulting blend of the colors A and L will be M4(A2−L3)+L3. This blended color will appear at the output of the arithmetic unit 51 in pixel time 7 and be advanced into the output register 53 in pixel time 8. In pixel time 7, the second iteration of the mix value M4 will appear in the mix pipeline register 49 while at the same time the color L3 appears in the old color register 47 while the color A5 appears in the new color register 45. As a result, in pixel time 8, a blend of the colors L3 and A5 will be produced at the output of the arithmetic unit 51 with the value of M4 used as the multiplier in the formula. The resulting blend of the color will be M4(L3−A5)+A5. In this manner, an M4 percentage of L3 is blended with a complementary percentage of A5 and produced in the output register 53 in pixel time 9.

In pixel time 8, the advance new and the advance old signals are not effective so that the colors A5 and L3 remain in the new and old color registers 45 and 47 in pixel time 8. In pixel time 9, the advance and advance old signals are effective so that the color A6 is advanced into the new color register 45 and the color A5 is advanced into the old color register 47. By pixel time 8, the second mix pipeline stage 49 will contain a zero, and it will also have a zero in pixel time 9. As a result, the colors A5 and A6 are produced at the output of the arithmetic unit 51 in pixel times 9 and 10, respectively, and are produced in the output register 53 in pixel times 10 and 11, respectively.

Table 2 requires that the advance new and advance old signal be effective to advance the values into these registers during each of pixel times 5 through 7. In pixel time 5, the advance new and advance old signals are effective in response to the pixel word history in pixel time 4 represented by the sequence A1, A2, L3 and M4 corresponding to the sequence CCXX. In pixel time 6, the advance new and advance old signals are effective in response to the pixel word history that occurred in pixel time 5 of A2, L3, M4, A5 corresponding to the sequence CCXX. In pixel time 7, the advance new and the advance old signals are effective in response to the pixel word history as represented in pixel time 6 of L3, M4, A5 and A6 corresponding to the sequence CMCC. The advance new and the advance old signals are not effective in pixel time 8 in response to the pixel sequence history in pixel time 7 of L3, M4, A5, A6 and A7 corresponding to the sequence CMCCC, so that A5 and L3 remain in the new and old color registers 45 and 47 in pixel time 8. It should be noted that it is irrelevant whether or not the advance new and the advance old signals are generated in pixel time 8 since the value A5 will appear in the new color register 45 in pixel time 8 regardless of whether or not the advance new signal is effective and the color value in the old color register 47 in pixel time 8 has no effect. The advance new and the advance old signals are effective in pixel time 9 in response to the pixel word history existing in pixel time 7 of A5, A6, A7, A8 corresponding to sequence CCXX.

Table 3 illustrates the flow of pixel words and corresponding colors through the system like that shown in FIG. 3 for the situation of two adjacent lines as illustrated in FIG. 2C. In Table 3, the pixel word sequence is A1, A2, K3, M4, L5, M6, A7, A8, A9 and A10.

TABLE 3

| | 1 | 2 | 3 | 4 | 5 | 6 | 7 | 8 | 9 | 10 | 11 | 12 | 13 |
|---|---|---|---|---|---|---|---|---|---|---|---|---|---|
| 33 | A1 | A2 | K3 | M4 | L5 | M6 | A7 | A8 | A9 | A10 | | | |
| 35 | | A1 | A2 | K3 | M4 | L5 | M6 | A7 | A8 | A9 | | | |
| 43 | | | A1 | A2 | K3 | L5 | L5 | A7 | A7 | A8 | | | |
| 45 | | | | A1 | A2 | K3 | K3 | L5 | A7 | A7 | A8 | | |
| 47 | | | | | A1 | A2 | A2 | A2 | L5 | L5 | A7 | | |
| 39 | 0 | 0 | 0 | 0 | M4 | M4 | M6 | M6 | 0 | 0 | | | |
| 49 | | 0 | 0 | 0 | 0 | M4 | M4 | M6 | M6 | 0 | 0 | | |
| 51 | | | | | A1 | A2 | M4 | M4 | M6 | M6 | A7 | A8 | |
| 53 | | | | | | A1 | A2 | M4 | M4 | M6 | M6 | A7 | A8 |
| A.N. | | | | 1 | 1 | 1 | 0 | 1 | 1 | 0 | 1 | | |
| A.O. | | | | | 1 | 1 | 0 | 0 | 1 | 0 | 1 | | |

The pixel words A1, A2 and K3 advance through the system in the situation illustrated in Table 3 up through pixel time 6 in the same manner as the pixel words A1, A2 and L3 advance through the system as shown in Table 2. Similarly, the mix value M4 advances through the system as shown in Table 3 in the same manner as the mix value M4 advances to the system as described with reference to Table 2 through pixel time 6. In pixel time 7, the advance new and advance old signals are not effective so that the values K3 and A2 are retained in the new color register 45 and the old color register 47. In addition, in pixel time 7, the antimix signal is effective so that the complementary value of M4 is registered in the stage 49 of the mix pipeline in pixel time 7. As a result, in pixel time 8, the arithmetic unit 51 will generate a blend at its output register corresponding to $\overline{M4}(A2-K3)+K3$. Since the multiplier $\overline{M4}$ is the complement of M4, this is equivalent to generating a blend in accordance with the formula M4 (K3−A2)+A2 which is what is desired for the trailing edge of the line 15 to be produced in pixel number 4 as shown in FIG. 2C. The blend for pixel number 4 is produced at the output of the arithmetic unit 51 at pixel time 8 in Table 3 and is produced in the output register 53 in pixel time 9.

Pixel word L5 corresponding to the line color of the line 17 enters input stage 33 in pixel time 5. The color L5 is registered in the output buffer 43 in pixel time 6 as a result of the mix value M4 being in the second input stage 35 in pixel time 5, but the color value L5 does not advance into the new color register in pixel time 7 because no new color advance signal is effective in pixel time 7. The color L5 is re-registered in the output buffer 43 in pixel time 7 as a result of the pixel word L5 being advanced into the second input stage 35 in pixel time 6. In pixel time 8, the advance new signal is effective without the advance old signal so that the color L5 is advanced into the new color register 45 while retaining the color A2 in the old color register 47. The mix value M6 which enters the input stage 33 in pixel time 6 advances into the mix pipeline stage 39 in pixel time 7 and appears in the second pixel pipeline stage 49 in pixel time 8. As a result, in pixel time 9, the arithmetic unit 51 will produce at its output register a blend of M6(A2−L5)+L5 which is the proper blend for the leading edge of the line 17 in pixel number 5, as shown in FIG. 2C. In pixel time 8, the mix value M6 is reiterated in the first stage 39 of the mix pipeline advancing into this stage from the second input stage 35. Accordingly, the mix value M6 is repeated in pixel time 9 in the second stage 49 of the mix pipeline. In pixel time 9, both the advance new and the advance old signals are effective so that the color A7 advances into the new color register 45 and the color L5 advances into the old color register 47. The pixel word A7, which entered the input stage 33 in pixel time 7, is applied to the input port of the RAM 31 in pixel time 7 as a result of the mix value M6 being in the second input state 35. Accordingly, the color A7 will appear in the output buffer 43 in pixel time 8 to be advanced into the new color register 45 in pixel time 9. Thus, in pixel time 10, the arithmetic unit 51 will produce a blend M6(L5−A7)+A7 at its output which is the correct blend for the trailing edge of the line 17 in FIG. 2C.

The pixel word A7 will remain in the new color register 45 in pixel time 10. In pixel time 10, the second stage 49 of the mix pipeline will contain a zero as a result of the two colors A7 and A8 being in registers 35 and 33 in pixel time 8. Accordingly, the arithmetic unit 51 produces the color A7 at its output in pixel time 11. The color A8 will be advanced into the new color register 45 in pixel time 11 and the arithmetic unit 51 produces the color A8 at its output in pixel time 12.

The flow of pixels and colors of Table 3 requires no advance new and no advance old signal to be effective in pixel time 7. This is in response to the pixel word history in pixel time 6 of A2, K3 and M4, L5, M6 corresponding to the sequence CCMCM. In pixel time 8, the advance new signal is effective, but the advance old signal is not effective. This is in response to the pixel word history in pixel time 7 of K3, M4, L5, M6 and A7. The last part of this sequence is CMX which causes the advance new signal to be generated. The advance new and the advance old signals are effective in pixel time 9 in response to the pixel word history existing in pixel time 8 of L5, M6, A7 and A8 corresponding to CMCC. In pixel time 10, the advance old and the advance new signals are not effective in response to the pixel word history that existed in pixel time 9 which corresponds to CMCCC, but they are irrelevant to the display. In pixel time 11, both the advance old and the advance new signals are generated in response to the pixel word sequence history that existed in pixel time 10, A7, A8, A9 and A10 which corresponds to CCXX. The antimix signal is effective in pixel time 7 in response to the pixel word history in pixel time 6 of K3, M4, L5 and M6 corresponding to CMCM.

Table 4 illustrates the flow of pixel words and corresponding colors through the system of FIG. 3 like the situation illustrated in FIG. 2D. In Table 4, the pixel word sequence is A1, A2, B3, M4, B6, B7 and B8 to represent a nearly vertical boundary between large objects bridge by pixel number 4 and corresponding to pixel word M4. As described with reference to FIG. 2D, the pixel word preceding the word corresponding to the boundary represents the color on the right side of the boundary. Thus, the pixel word corresponding to pixel number 3 is B3.

The fact that the situation in FIG. 2D is an edge between two large objects is indicated by the occurrence of the pixel word sequence containing two consecutive mix values M4 and M5. Because the boundary is a nearly vertical boundary so that it does not extend through more than one pixel in a horizontal sequence of pixels, the mix value M5 is assigned a mix value of zero.

TABLE 4

| | 1 | 2 | 3 | 4 | 5 | 6 | 7 | 8 | 9 | 10 | 11 | 12 | 13 |
|---|---|---|---|---|---|---|---|---|---|---|---|---|---|
| 33 | A1 | A2 | B3 | M4 | M5 | B6 | B7 | B8 | B9 | | | | |
| 35 | | A1 | A2 | B3 | M4 | M5 | B6 | B7 | | | | | |
| 43 | | | A1 | A2 | B3 | M5 | B6 | B6 | B7 | | | | |
| 45 | | | | A1 | A2 | B3 | B3 | B3 | B6 | B7 | | | |
| 47 | | | | | A1 | A2 | A2 | A2 | B3 | B6 | | | |
| 39 | 0 | 0 | 0 | 0 | M4 | M4 | M5 | 0 | 0 | | | | |
| 49 | | 0 | 0 | 0 | 0 | M4 | M4 | M5 | 0 | 0 | | | |
| 51 | | | | | A1 | A2 | M4 | M4 | M5 | B6 | B7 | | |
| 53 | | | | | | A1 | A2 | A2 | M4 | M5 | B6 | B7 | |
| A.N. | | | | 1 | 1 | 1 | 0 | 0 | 1 | 1 | | | |
| A.O. | | | | | 1 | 1 | 0 | 0 | 1 | 1 | | | |

As shown in Table 4, the pixel words A1, A2 and B3, the corresponding color values, and the mix value M4 will flow through the system of FIG. 3 in the same manner as in Table 2 up through pixel time 4. In pixel time 5, the first mix value M4 will be registered in the first mix pipeline stage 39 and will also be registered in the second input stage 35. The mix value M5 will be registered in the first input stage 33. In pixel time 6, both the advance new and the advance old signals will be effective to cause the color B3 to be shifted into the new color register 45 and the color A2 to be shifted into the old color register 47. The mix value M4 will be shifted into the second stage 49 of the mix pipeline and a duplicate of the mix value M4 will be shifted into the first stage 39 of the mix pipeline from the second input stage 35. In pixel time 5, the mix value M5 will be applied to the input port of the RAM 31 so that in pixel time 6, a nonexistent color will be read out into the buffer register 43 from the address location represented by the pixel word value M5. However, this false color value will be discarded and is not used in the display. As a result of the values in the second mix pipeline stage 49 and in the old and new color registers 47 and 45 in pixel time 6, the arithmetic unit 51 will produce a blend at its output in pixel time 7 corresponding to M4. This blend will be discarded and not be used in the display as is explained below. In pixel time 7, the output register 53 will contain the color A2 as a result of this color being in the new color register 45 in pixel time 5 and the mix value zero being in the second mix pipeline stage 49 in pixel time 5. In pixel time 8, the don't change signal will be effective and cause the color A2 to be retained in the output register 53. Thus, the blend corresponding to the mix value M4 at the output of the arithmetic unit 51 in pixel time 7 is not used. In pixel time 7, the advance new and the advance old signals are not effective so that the colors B3 and A2 stay in the new color and the old color registers 45 and 47. Also in pixel time 7, the second iteration of the mix value M4 is advanced into the second mix pipeline stage 49 with the mix value M5 being advanced into the first mix pipeline stage 39. As a result, in pixel time 8, the arithmetic unit 51 will produce a blend at its output register corresponding to M4(A2−B3)+B3 which is the correct blend for pixel number 4 bridging the pixel boundary passing through this pixel in FIG. 2D. In pixel time 8, the mix value M5 is advanced into the second mix pipeline stage 49, while a mix value of zero enters the first mix pipeline state 39. The advance new and the advance old signals are not effective so the values B3 and A2 remain in the new color and the old color stages 45 and 47. Accordingly, in pixel time 9, the arithmetic unit 51 produces the blend M5(A2−B3)+B3. Since M5 contains a mix value of zero, the blend produced at the output of the arithmetic unit 51 in pixel time 9 is the pure color B3. In pixel time 9, the advance new and the advance old signals are effective so that the colors B6 and B3 are advanced into the new and the old color registers 45 and 47, respectively. The mix value zero is advanced into the second mix pipeline stage 49 in pixel time 9 while another mix value of zero enters the first mix pipeline stage 39. Accordingly, in pixel time 10, the color B6 will be generated at the output of the arithmetic unit 51. By a similar process, the color B7 will be generated at the output of the arithmetic unit 51 in pixel time 11.

In pixel time 6, the advance new and the advance old signals are effective in response to the pixel word history in pixel time 5 of A2, B3, M4 and M5 corresponding to CCXX. In pixel time 7, neither the advance new nor the advance old signal is effective in response to the pixel word history in pixel time 6 of A2, B3, M4, M5 and B6 corresponding to CCMMC. In pixel time 8, neither the advance new nor the advance old signal is effective in response to the pixel word history in pixel time 7 of B3, M4, M5, B6 and B7 corresponding to CMMCC. In pixel time 9, both the advance new and the advance old signals are effective advance new and the advance old signals are effective in response to the pixel word sequence history in pixel time 8 of M4, M5, B6, B7 and B8 corresponding to MXCCX. The don't change signal is generated in response to the pixel word history that existed in pixel time 5 of A2, B3, M4, and M5 corresponding to CCMM and is pipelined to be effective n pixel time 8. The flow illustrated in Table 4 would be the same for an edge between two large objects which was more horizontal such that it passed through two pixels in the same horizontal row. In this case, M5, instead of being given the value zero, would be given the value corresponding to how the boundary divided pixel number 5 in FIG. 2D.

Table 5 illustrates a situation like that of FIG. 2F representing a nearly vertical line and intersecting a nearly horizontal boundary between two large objects. In Table 5, the pixel sequence is A1, A2, B3, M4, M5, L6, M7, B8, M9, M10, B11, B12, B13 and B14. It will be recalled from the description of FIG. 2F, L6 is the line color of the line of the line 23 and M7 is a mix value indicating how the colors of the line 23 are to be blended with the background color. Also, it will be recalled that the pixel word B8 is not to cause the display the color B in pixel number 8, the pixel word B8 merely serves to re-establish the color B as the color registered in the new color register.

TABLE 5

| | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| 33 | A1 | A2 | B3 | M4 | M5 | L6 | M7 | B8 | M9 | M10 | B11 | B12 | B13 | B14 | | |
| 35 | | A1 | A2 | B3 | M4 | M5 | L6 | M7 | B8 | M9 | M10 | B11 | B12 | B13 | | |
| 43 | | | A1 | A2 | B3 | M5 | L6 | L6 | B8 | B8 | M9 | B11 | B11 | B12 | | |
| 45 | | | | A1 | A2 | B3 | B3 | B3 | L6 | L6 | B8 | B8 | B8 | B11 | B12 | |
| 47 | | | | | A1 | A2 | A2 | A2 | A2 | A2 | A2 | A2 | A2 | B8 | | |
| 39 | | | | | M4 | M4 | M5 | M7 | M7 | M9 | M9 | M10 | 0 | 0 | | |
| 49 | | | | | | M4 | M4 | M5 | M7 | M7 | M9 | M9 | M10 | 0 | 0 | |
| 51 | | | | | A1 | A2 | M4 | M4 | M5 | M7 | M7 | M9 | M9 | M10 | B11 | B12 |
| 53 | | | | | | A1 | A2 | A2 | M4 | M5 | M7 | M7 | M9 | M9 | M10 | B11 |
| A.N. | | | | 1 | 1 | 1 | 0 | 0 | 1 | 0 | 1 | 0 | 0 | 1 | 1 | |
| A.O. | | | | | 1 | 1 | 0 | 0 | 0 | 0 | 0 | 0 | 0 | 1 | 1 | |

In Table 5, the pixel words A1, A2, B3, M4, M5 and L6 flow through the system of FIG. 3 in pixel times 1–7 in the same manner as the first six pixel words of the situation illustrated in Table 4 flow through the system. In pixel time 7 in Table 5, a mix value M7 enters input stage 33. In pixel time 8, the mix value M7 advances into the first mix pipeline stage 39 as well as into the second input stage 35. In pixel time 9, both mix pipeline stages 39 and 49 will contain the mix value M7. The color B8 will be registered in the buffer register 43 in pixel time 9 as a result of the pixel word B8 entering the input stage 33 in pixel time 8. In addition, the pixel word B8 will be advanced into the second input stage 35 in pixel time 9. As a result of the mix value M7 being in the second mix pipeline stage 49, the line color L6 being in the new color register 45 and the color A2 being in the old color register 47, in pixel time 9, the arithmetic unit 51 will produce a blend at its output in pixel time 10 in accordance with the formula M7(A2−L6)+L6. In this manner, the blend for pixel number 6 bridging the leading edge of the line 23 as shown in FIG. 2F is produced at the output of the arithmetic unit 51 in pixel time 10. In pixel time 10, the mix value M9 is advanced into the first mix pipeline stage 39 as well as into the second input stage 35. The color B8 is again read out of the RAM 31 into the output register 43. The advance new and the advance old signals are not effective so the colors L6 and A2 remain in the new and old color registers 45 and 47. The mix value M7 has its complement, $\overline{M}$7 registered in the second mix pipeline stage 49. As a result, in pixel time 11, the arithmetic unit 51 produces at its output a blend $\overline{M}$7(A2−L6)+L6. This blend is the same as M7(L6−A2)+A2. In this manner, the system produces in pixel number 7 the correct blend of the colors L6 and A2 for the trailing edge of the line 23 in the situation illustrated in FIG. 2F. In pixel time 11, the mix value M10 is advanced from input stage 33 to the second input stage 35. The mix value M9 is duplicated in both pipeline stages 39 and 49. The advance new signal is effective in pixel time 11 without the advance old signal so that the color B8 is advanced into the new color register 45 while retaining the old color A2 in the old color register 47. Accordingly, in pixel time 12, the arithmetic unit 51 produces a blend of the colors B8 and A2 in accordance with the formula M9(A2−B8)+B8. In this manner, the system produces a blend in pixel number 8 in FIG. 2F which will be identical to the blend which is produced in pixel number 9. As explained above with reference to FIG. 1F, a blended color needs to be generated for the pixel 8 since the normal mix value for this pixel has been replaced in the sequence by the color pixel word B8 and the blend from pixel 9 is used in pixel No. 8. As shown in Table 5, the second iteration of the value M9 is moved into the second mix pipeline stage 49 in pixel time 12 while the values B8 and A2 are retained in the new color and old color registers 45 and 47. As a result, in pixel time 13, the arithmetic unit 51 produces at its output the blend M9(A2−B8)+B8, which is the same blend that it produces in pixel time 12. By processes similar to those already described, the arithmetic unit produces a blend M10(A2−B8)+B8 in pixel time 14 corresponding to pixel number 10 in FIG. 2F and then produces the colors B11 and B12 in pixel times 15 and 16 corresponding to pixel Nos. 11 and 12 in FIG. 2F.

In Table No. 5, both the advance new and the advance old signals are effective in pixel times 5 and 6 for the same reasons that they are effective in these pixel times as explained with reference to Table 4. In pixel time 7, neither the advance new nor the advance old signal is effective in response to the pixel word history in pixel time 6 of A2, B3, M4, M5, and L6 corresponding to CCMMC. In pixel time 8 neither the advance new nor the advance old signal is effective in response to the pixel word history in pixel time 7 of B3, M4, M5, L6 and M7 corresponding to CMMCM. In pixel time 9, the advance new signal is generated without generating the advance old signal in response to the pixel word sequence history in pixel time 8 of L6, M7, B8 corresponding to CMX. In pixel time 10, neither the advance new or the advance old signal is effective in response to the pixel word history in pixel time 9 of M5, L6, M7, B8 and M9 corresponding to MCMCM. In pixel time 11, the advance new signal is generated without the advance old signal being generated in response to the pixel word history in pixel time 10 of B8, M9, and M10 corresponding to CMX. In pixel time 12, neither the advance new or the advance old signal is effective in response to the pixel word history in pixel time Il of M7, B8, M9, M10 and B11 corresponding to MCMMC. In pixel time 13, neither the advance new nor the advance old signal is effective in response to the pixel word history in pixel time 12 of B8, M9, M10, B11, and B12 corresponding to CMMCC. In pixel time 14, both the advance new and the advance old signal is generated in response to the pixel word history in pixel time 13 of M9, M10, B11, B12 and B13 corresponding to MXCCX. In pixel time 15, both the advance new and the advance old signals are generated in response to the pixel word history in pixel time 14 of B11, B12, B13 and B14 corresponding to CCXX. The antimix signal is effective in pixel time 10 in response to the pixel word history in pixel time 9 of L6, M7, B8, and M9 corresponding to CMCM.

In this manner, the system effectively achieves rules 1–7 to produce the desired blends for lines one pixel wide as well as for boundaries between large objects and handles the situation of lines being close together as well as lines intersecting horizontal boundaries.

Figure 4:
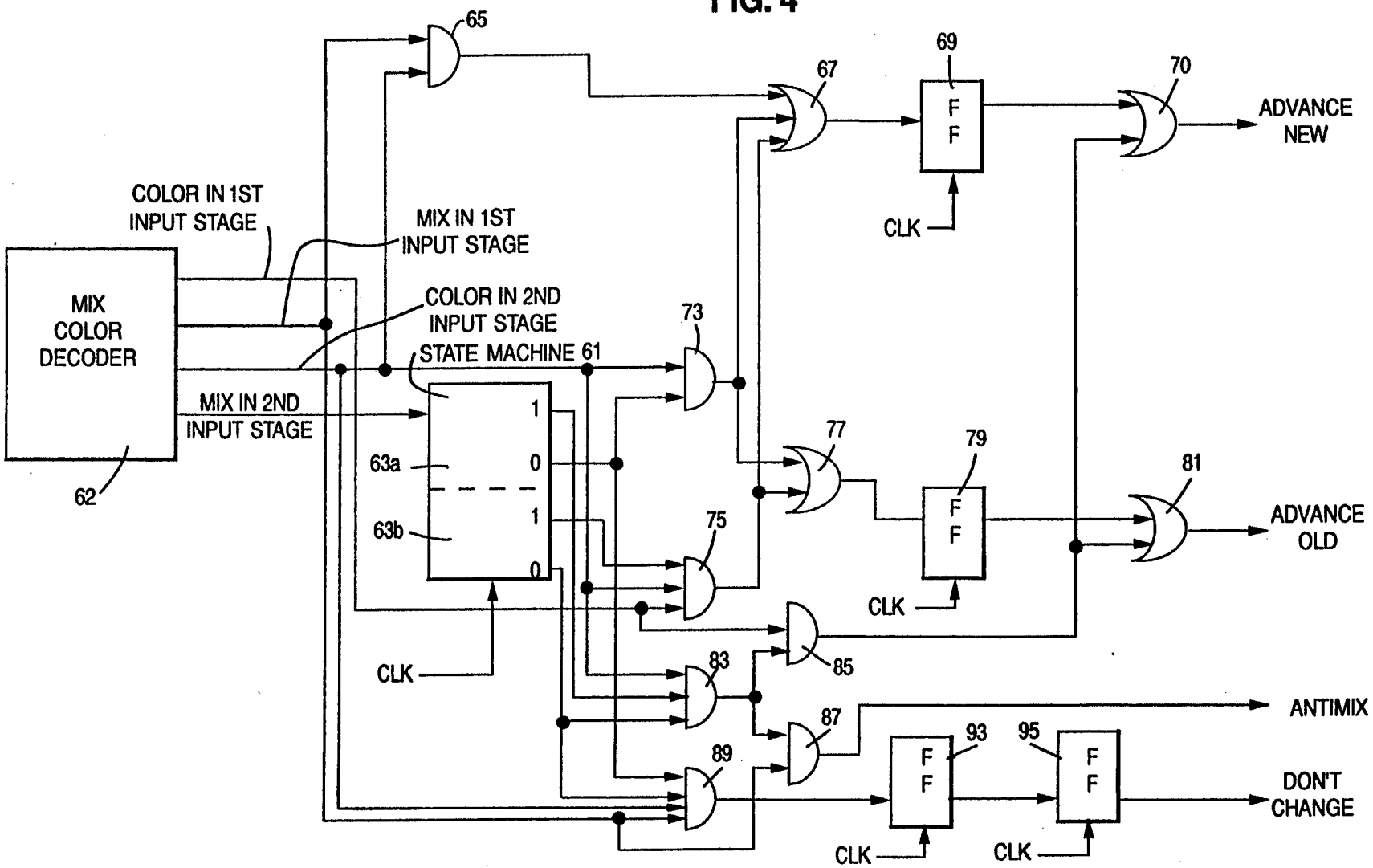
FIG. 4 is a block diagram illustrating details of the control logic used in the system of the invention.

FIG. 4 illustrates the logic of the CEG control unit 41 for generating the advance new, the advance old, the antimix signal and the don't change signal. As shown in FIG. 4, the control unit comprises a mix color decoder 62, which detects the character of the pixel words in the input stages 33 and 35 and produces output signals indicating the presence of color pixel words or mix values in each of these stages. The decoder determines the character of the pixel word by responding to the three most significant bits of the pixel words. If the three most significant bits are all ones, it means that the address value exceeds 223 and the pixel word is a mix value. If the three most significant bits are not all ones, the pixel used is a color pixel word. A state machine 61 receives signals from the mix color decoder 62 indicating whether the second input sate 35 contains a mix value or is a color pixel word. The state machine 61 comprises a two-stage output counter 63 which advances through counts 0, 1, 2 or 3. The state machine 61 also receives the pixel clock pulses and the counts in the output stages are set in the next pixel clock period in accordance with the character of the current pixel word in the second input stage 35. Whenever two color pixel words occur in a row in input state 35, the counter of the state machine 61 is set to register a count of zero in the next pixel clock period. When the counter of the state machine 61 registers a count of zero, and the input stage 35 registers a mix value, then in the next pixel clock period, the state machine counter will advance to a count of one. When the counter of the state machine registers a count one and the second input stage 35 registers a color pixel word, then the state machine 61 will be advanced to register a count of two in the next pixel clock period. When the state machine registers a count of one and the pixel word registered in the second stage 35 is a mix value, the state machine 61 is advanced to a count of 3 in the next pixel clock period. When the state machine register registers a count of two and the pixel word in stage 35 is a mix value, the counter 61 is returned to a count of one in the next pixel clock period. If a mix value is registered in the second input stage 35 while the counter of the state machine 61 registers a count of three, the counter will retain a count of three in the next pixel clock period. When the counter of the state machine 61 registers a count of three and the pixel word registered in the second stage 35 is a color pixel word, then the counter of the state machine 61 will return to a count of 2 in the next pixel clock period. Accordingly, whenever the last two pixel words in stage 35 have the sequence CC, the state machine will be set to count zero, whenever, the last two pixel words have the sequence CM, the state machine will register a count of one. Whenever the last sequence of pixel words is MC, the state machine 61 will register a count of two and whenever the last sequence of pixel words is MM, the state machine will register a count of three. These counts will register in the counter 63 of the state machine 61 in the pixel clock time immediately following the pixel clock time when the last pixel word of the sequence was registered in the second input stage 35. The counter 63 has two flip-flop output stages 63*a* and 63*b* to register the count by means of binary bits. The first stage will store a bit of zero when the count is zero or when the count is two and will store a count of one when the count registered by the counter is one or the count registered by the counter is three. The second flip-flop stage 63*b* will register a count of one when the count registered by the counter is two or when the count registered by the counter is three. The logic of the state machine 61 is implemented simply by setting the first stage 63*a* to a one or a zero in accordance with whether the second input stage 35 contains a mix value or a color pixel word respectively in the next pixel clock period and by setting the second counter stage 63*b* to equal the bit in the first counter state 63*a* in the following pixel clock period.

A gate 65 receives an enabling signal from the mix color decoder 62 whenever there is a mix value in the first input stage 33 and also receives an enabling input signal from the mix color decoder 62 when there is a color pixel word in the second input stage 35. Accordingly, the gate 65 will produce a high output in response to the combination of a mix value in the first input stage 33 and a color pixel word in the second input stage 35. The output signal of the gate 65 is applied through an OR gate 67 to a flip-flop 69 and when the output signal of the gate 65 is high, the flip-flop 69 will be set to its one state in the next succeeding pixel clock period. The output of the flip-flop 69 is applied through an OR gate 70 to the advance new signal line. Accordingly, whenever there is a mix in the first input stage and a color in the second input stage, then in the next succeeding pixel clock time, the advance new signal will be generated.

In this manner, the advance new signal is generated in response to the sequence CMX.

The first stage 63*a* of the counter 63 will apply an enabling signal to an AND gate 73 whenever this first stage 63*a* contains a zero. Thus, this enabling signal is applied when the count in the counter 63 is zero or two, which in turn means that the pixel word registered in the second input stage 35 in the preceding pixel clock time was a color pixel word. The gate 73 also receives an enabling signal from the mix color decoder 62 whenever the second input stage 35 contains a color pixel word and will produce a high output signal whenever it receives an enabling signal on both of its inputs. Accordingly, the gate 73 will produce a high output whenever there is a color pixel word in the second input stage 35 and the preceding pixel word was also a color pixel word. The output of the gate 73 is applied through the OR gate 67 to the flip-flop 69 and will set the flip-flop 69 to its one state in the next pixel clock period when the output of the gate 73 is high. In this manner, the flip-flop 69 generates the advance new signal in response to the sequence CCXX.

When the second stage 63*b* of the counter 63 contains a one meaning that the count registered in the counter 63 is two or three, the second stage 63*b* will apply an enabling signal to a gate 75, which is also connected to receive an enabling signal from the mix color decoder when there is a color pixel word in the second input stage 35 and a third enabling signal from the mix color decoder 62 when there is a color pixel word in the first input stage 33. When the gate 75 receives enabling signals on all three inputs, its output will go high. The output of the gate 75 is applied through the OR gate 67 to the flip-flop 69 and when the output of the gate 75 is high, it will set the flip-flop 69 in its one state in its next pixel clock period. The stage 63*b* will be in its one state to apply an enabling signal to the gate 75 when the sequence of pixel words in the preceding pixel clock time was MC or MM. Accordingly, the gate 75 will produce a high output signal when the preceding sequence of pixels received by the first input stage 33 was MXCC. The delay of one clock period provided by the flip-flop 69 makes the flip-flop 69 produce the advance new signal then in response to the sequence of MXCCX. Whenever the outputs of all three gates 65, 73, and 75 are low, the output of the OR gate 67 will be low and the flip-flop 69 will be set to its zero state in the next pixel clock period. Thus, the flip-flop 69 produces the advance new signal only in response to the sequences CMX, CCXX and MXCCX. The outputs of the gates 73 and 75 are applied through an OR gate 77 to a flip-flop 79 and whenever the outputs of either the gate 73 or the gate 75 is high, it will set the flip-flop 79 to its one state. Whenever both of the outputs of the gates 73 and 75 are low, the flip-flop 79 will be set to its zero state in the next succeeding clock period. The output of the flip-flop 79 is applied through an OR gate 81 to the advance old signal line. In this manner, the advance old signal is generated in response to the sequences CCXX, and MXCCX.

Whenever the first stage 63*a* of the counter contains a one, it will apply an enabling signal to a gate 83, which is also connected to receive an enabling signal from the second stage 63*b* of the counter 63 whenever this stage contains binary zero. Thus, the gate 83 will receive enabling signals on two of its input lines when the counter 63 contains a count of one. This will mean that both enabling signals will be applied to the gate 83 when the most recent pixel word history in the second input stage in the preceding pixel clock time was CM. The gate 83 also receives an enabling signal from the mix color decoder 62 when the second input stage 35 contains a color pixel word. The gate 83 will produce a high output signal when it receives enabling signals on all three inputs and, thus, will produce an enabling output signal in response to the sequence CMCX as currently received in the first input stage 33. The output of the gate 83 is applied to a gate 85 and to a gate 87. The gate 85 is connected to receive an enabling signal from mix color decoder 62 when there is a color pixel word in the first input stage 33 and it will produce a high output signal when it receives this enabling signal and a high output signal from the gate 83. Thus, the gate 85 will produce a high output signal when the latest sequence of pixels registered in the input stage 83 is CMCC. The output signal of the gate 85 is applied through the OR gate 70 to become the advance new signal and through and OR gate 81 to become the advance old signals are generated in response tot he sequence CMCC.

The gate 87 is connected to receive an enabling signal from the mix color decoder 62 whenever a mix value is in the first input stage and will produce a high output signal as the antimix signal whenever it receives a high input signal from the gate 83 and the enabling signal from the mix color decoder. In this manner, the gate 87 produces the antimix signal in response to the sequence CMCM as most recently received in the first input stage 33.

The advance new and advance old signals are effective to advance colors into the new color register and the old color register in the next pixel clock time after they are generated. This one pixel delay occurs because the conditions causing generation of the signals occur in response to a pixel clock pulse and the signals are then in existence and effective when the next pixel clock pulse occurs to cause the shifting of the color values.

The stages 63*a* and 63*b* will each apply an enabling signal to an AND gate 89 whenever these two stages contain binary zeros meaning that the counter 63 registers a count of zero. The gate 89 will also receive an enabling signal from the mix color decoder 62 when there is a mix value in the first input state 33. In addition, a fourth enabling signal is applied to the gate 89 from the mix color decoder 62 when there is a mix value in the second input stage 35. When the gate 89 receives enabling signals on all four inputs, it produces a high output signal and all other times, it produces a low output signal. The inputs to the gate 89 mean that the gate 89 will produce a high output whenever the latest pixel sequence received in the input stage 33 is CCMM. The high/low state of the output of the gate 89 is delayed two pixel clock periods by a pipeline of flip-flops 93 and 95 to be effective on the buffer register 53 as the don't change signal three pixel clock times after the generation of the signal by the gate 89.

The above-described antialiasing system effectively eliminates the distortion of aliasing as perceived by the viewer for a display including solid objects of indeterminate size as well as lines one pixel wide and allows the lines to intersect or abut the solid objects and be drawn in close proximity to one another. The antialiasing works on both the boundaries of the lines and the solid objects.

The above description is of the preferred embodiment of the invention and modification may be made thereto without departing form the spirit and scope of the invention, which is defined in the appended claims.

We claim:

1. In a pixel based display system having a display device defining a multiplicity of pixels, and control means to control the intensity displayed in said pixels to display an image, said control means including antialiasing means to reduce aliasing distortion by controlling the intensity of pixels bridging boundaries between objects in said image to be blends of the intensities in said image on each side of such boundaries, wherein the percentage of the intensity used in the blends is determined by mix values represented by binary words; the improvement wherein said control means includes line drawing means to control the intensity of said pixels to represent diagonal lines one pixel wide and wherein said antialiasing means controls the blends in each pair of adjacent horizontal pixels bridging the leading and trailing edge of a diagonal line in accordance with the same mix value represented by a single binary word.

2. In a pixel based display device as recited in claim 1, wherein said display device is a color display device, said control means controls the colors displayed in each of said pixels to display an image in color, and said antialiasing means controls the colors in pixels bridging boundaries between objects to be blends of the colors on each side of such boundaries.

3. In a pixel based display system as recited in claim 1, wherein said control means controls the intensities of said pixels in response to pixel words each corresponding to one of said pixels, said pixel words including said binary words representing said mix values.

4. In a pixel based display device as recited in claim 3, wherein said pixel words are arranged in sequences corresponding to sequences of horizontal pixels and wherein a first set of said pixel words represent intensities in a corresponding pixel and a second set of said pixel words comprise said a words representing said mix values, and wherein a sequence of pixel words containing a single pixel word of said second set surrounded by pixel words of said first set represents a diagonal line, and a plurality of pixel words of said second set in sequence represents a boundary between large objects.

5. In a pixel based display as recited in claim 4, wherein a sequence of pixel words of said first set preceded by a plurality of pixel words of said second set in sequence and succeeded by only one pixel word of said second set represents a diagonal line intersecting a generally horizontally extending boundary between objects.

6. In a pixel based display system as recited in claim 3, wherein a first set of said pixel words represent an intensity of the corresponding pixel, a second set of said pixel words comprise said binary words representing mix values, said control means comprises a first register, a second register, and sequence responsive means responsive to a pixel word of said first set and a predetermined sequence of pixel words to store an intensity value in said first register represented by such pixel word of said first set, and responsive to a predetermined sequence of pixel words to advance the intensity in said first register into said second register, and blending means to control the pixels bridging boundaries in said image to be blends of the intensities in said first register and said second register blended in accordance with one of said mix values.

7. In a pixel based display system as recited in claim 6, wherein said sequence responsive means is responsive to a predetermined sequence of said pixel words to generate an antimix value corresponding to the complement of one of said mix values and wherein said blending means controls the blend of the intensities in said first register and said second register in a selected pixel in accordance with said antimix value.

8. In a pixel based display system as recited in claim 6, wherein said sequence responsive means is responsive to a predetermined sequence of pixel words to maintain the color in a given pixel to be the same color as in the preceding pixel.

9. In a pixel based display system as recited in claim 6, wherein said control means controls the intensity in the pixel bridging the leading edge of said diagonal line by storing the intensity preceding the leading edge in said second register, and storing line intensity in said first register and controls the leading edge bridging pixel to be a blend of the intensities in the first register and the second register with percentages determined by a selected mix value and wherein said control means controls the intensity in a second pixel bridging the trailing edge of a diagonal line adjacent to said first pixel by advancing said line intensity from said first register to said second register, storing the image intensity beyond said trailing edge in said first register and controlling the blend in said second pixel to be percentages of the intensity in said first register and said second register determined by said selected mix value.

10. A method of controlling a pixel based color display defining a multiplicity of pixels to display a color image including at least one diagonal line only one pixel wide comprising generating a sequence of pixel words to represent said color image, each of said pixel words corresponding to one of said pixels in said display, some of said pixel words being color pixel words and representing a color to be displayed in the corresponding pixel and some of said pixel words containing mix values to control the percentage of colors to be blended together in some of said pixels at boundaries between objects in said image, controlling the color in a first pixel bridging the leading edge of said line to be a blend of the line color and the color of said image preceding the leading edge of said line with the percentages of the colors controlled by a mix value in one of said pixel words, and controlling he color of a second pixel bridging the trailing edge of said line adjacent to said first pixel to be a blend of percentages of said line color and the color succeeding said trailing edge in said image with the percentages of the blend controlled by the mix value in said one of said pixel words.

11. A method of controlling a pixel based color display as recited in claim 10, further comprising placing said line color in a new color register and placing the color preceding the leading edge of said line in an old color register and controlling the blend in said first pixel in accordance with a predetermined mathematical formula containing the color in said new color register, the color in said old color register and the mix value in said one of said pixel words, and advancing the line color from said new color register to said old color register, storing the color beyond the trailing edge of said line in said new color register and controlling the blend in said second pixel in accordance with said formula.

12. A method of controlling a pixel based display defining a multiplicity of pixels to display a color image including at least one boundary between large objects and at least one diagonal line one pixel wide comprising generating a train of pixel words to represent a color image to be displayed, each of said pixel words corresponding to a pixel in said pixel based display, some of said pixel words being color pixel words and representing a color to be displayed, some of said pixel words containing mix values to control the percentages of colors to be blended together in pixels bridging said boundary and in pixels bridging the leading and trailing edges of said line, representing said boundary between large objects passing through a set of adjacent pixels by a sequence of pixel words each containing a mix value, the mix value in at least one of the pixel words of said sequence representing the percentages of the colors to be blended in a pixel bridging said boundary, representing said diagonal line where it intersects a set of adjacent pixels by a pair of pixel words, one being a color pixel word and the other containing a mix value representing the percentages to be blended in the pixels bridging the leading and trailing edge of said diagonal line, and displaying the image represented by said pixel words with the pixels bridging said boundary controlled in accordance with the corresponding mix values contained in said pixel words and with the pixels in said set of adjacent pixels controlled in accordance with the mix value in the other pixel word of said pair of pixel words.

13. A method of controlling a pixel based color display as recited in claim 12, wherein said boundary between large objects is a nearly vertically extending boundary and wherein one of the mix values in said sequence of pixel words is selected to blend a zero percent of one of the two colors to be blended with a hundred percent of the other of the two colors to be blended.

14. In a pixel based display system having a display device defining a multiplicity of pixels and control means to control the intensity displayed in said pixels to display an image in response to pixel words, wherein each of said pixel words corresponds to said one of said pixels, said control means including antialiasing means to reduce distortion by controlling the intensity of pixels bridging boundaries between said objects in said image to be blends of the intensities in said image on each side of such boundaries, wherein a percentage of intensities used in the blends is determined by mix values in said pixel words, wherein pixel words are arranged in sequences corresponding to sequences of horizontal pixels and wherein a first set of said pixel words represent intensities in a corresponding pixel and a second set of pixel words comprise mix values; the improvement wherein said control means includes line drawing means to control the intensity of pixels to represent diagonal lines one pixel wide and said antialiasing means controls the blends in the pixels bridging the leading and trailing edges of said diagonal lines in accordance with said mix values, and wherein a sequence of pixel words containing a single pixel word of said second set surrounded by pixel words of said first set represents a diagonal line passing through a set of horizontal pixels and a plurality of pixel words of said second set in sequence represents a boundary between large objects passing through a set of horizontal pixels.

15. In a pixel based display as recited in claim 14, wherein a sequence of pixel words of said first set preceded by a plurality of pixel words of said second set in sequence and succeeded by only one pixel word of said second set represents a diagonal line intersecting a generally horizontally extending boundary between objects.

16. In a pixel based display system having a display device defining a multiplicity of pixels, and control means to control the intensity displayed in said pixels to display an image in response to pixel words each corresponding to one of said pixels, said control means including antialiasing means to reduce aliasing distortion by controlling the intensity of pixels bridging the boundaries between objects in said image to be blends of the intensities in said image on each side of said boundaries, wherein the percentage of intensity used in the blends in determined by mix values contained in said pixel words, a first set of said pixel words each representing the intensity of a corresponding pixel, a second set of said pixel words containing mix values; the improvement wherein said control means includes line drawing means to control the intensity of said pixels to represent diagonal lines one pixel wide, wherein said antialiasing means controls the blends in each pixel bridging the leading or trailing edge of the diagonal line in accordance with said mix values, and wherein said control means comprises a first register, a second register, sequence responsive means responsive to a pixel word of said first set and a predetermined sequence of pixel words to store an intensity value in said first register represented by said such pixel word of said first set and responsive to a predetermined sequence of pixel words to advance the intensity in said first register into said second register, and blending means to control the pixels bridging boundaries in said image to be blends of the intensities in said first register and said second register blended in accordance with one of said mix values.

17. In a pixel based display system as recited in claim 16, wherein said sequence responsive means is responsive to a predetermined sequence of said pixel words to generate an antimix value corresponding to the complement of one of said mix values and wherein said blending means controls the blend of the intensities in said first register and said second register in a selected pixel in accordance with said antimix value.

18. In a pixel based display system as recited in claim 16, wherein said sequence responsive means is responsive to a predetermined sequence of pixel words to maintain the color in a given pixel to be the same color as in the preceding pixel.

19. In a pixel based display system as recited in claim 16, wherein said control means controls the intensity in the pixel bridging the leading edge of said diagonal line by storing the intensity preceding the leading edge in said second register, and storing the line intensity in said first register and controls the leading edge bridging the pixel to be a blend of the intensities in said first register and the second register with percentages determined by a selected mix value and wherein said control means controls the intensity in a second pixel bridging the trailing edge of a diagonal line adjacent to said first pixel by advancing said line intensity from said first register to said second register, storing the image intensity beyond said trailing edge in said first register and controlling the blend in said second pixel to be percentages of the intensity in said first register and said second register determined by said selected mix value.

* * * * *

UNITED STATES PATENT AND TRADEMARK OFFICE

CERTIFICATE OF CORRECTION

PATENT NO. : 5,140,315

DATED : August 18, 1992

INVENTOR(S) : Steven D. Edelson et al.

It is certified that error appears in the above-identified patent and that said Letters Patent is hereby corrected as shown below:

Column 5, line 19, change "17 In" to --17. In--.

Column 7, line 17, after "display"; insert --.--;
line 32, "change "Which" to --which--.

Column 10, line 33, change "w[ll" to ---will--;
line 35, change "31 If" to --31. If--.

Column 25, line 10, after "old", insert --signal. In this manner, the advance new and the advance old--, and change "tot he" to --to the--.

Column 25, line 58, change "form" to --from--.

Signed and Sealed this

Seventh Day of September, 1993

*Attest:*

*Attesting Officer*

BRUCE LEHMAN

*Commissioner of Patents and Trademarks*